US010706997B2

(12) United States Patent
Li

(10) Patent No.: US 10,706,997 B2
(45) Date of Patent: Jul. 7, 2020

(54) PREPARATION OF MNBI LTP MAGNET BY DIRECT SINTERING

(71) Applicant: FORD GLOBAL TECHNOLOGIES, LLC, Dearborn, MI (US)

(72) Inventor: Wanfeng Li, Novi, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 321 days.

(21) Appl. No.: 15/627,517

(22) Filed: Jun. 20, 2017

(65) Prior Publication Data

US 2018/0366247 A1 Dec. 20, 2018

(51) Int. Cl.

| | |
|---|---|
| ***B22F 3/10*** | (2006.01) |
| ***B22F 3/16*** | (2006.01) |
| ***C22C 22/00*** | (2006.01) |
| ***H01F 1/055*** | (2006.01) |
| ***C22C 1/04*** | (2006.01) |
| ***H01F 1/08*** | (2006.01) |
| *B22F 9/04* | (2006.01) |
| *B22F 3/02* | (2006.01) |

(52) U.S. Cl.

CPC ..... *H01F 1/0557* (2013.01); *B22F 3/1017* (2013.01); *B22F 3/162* (2013.01); *C22C 1/04* (2013.01); *C22C 22/00* (2013.01); *H01F 1/086* (2013.01); *B22F 3/02* (2013.01); *B22F 3/16* (2013.01); *B22F 9/04* (2013.01); *B22F 2009/043* (2013.01); *B22F 2009/044* (2013.01); *B22F 2201/10* (2013.01); *B22F 2998/10* (2013.01); *C22C 1/0491* (2013.01); *C22C 2202/02* (2013.01)

(58) Field of Classification Search
None
See application file for complete search history.

(56) References Cited

U.S. PATENT DOCUMENTS

| | | | | |
|---|---|---|---|---|
| 2,825,670 | A | 3/1958 | Adams et al. | |
| 5,648,160 | A | 7/1997 | Kishimoto et al. | |
| 2015/0325349 | A1* | 11/2015 | Gabay | B22F 9/04 335/302 |
| 2016/0035487 | A1* | 2/2016 | Kim | C22F 1/16 419/33 |

FOREIGN PATENT DOCUMENTS

| | | | |
|---|---|---|---|
| CN | 105671346 | A | 2/2016 |
| KR | 101693519 | B1 | 1/2017 |

OTHER PUBLICATIONS

Mitsui, Yoshifura "magnetic field induced . . . " Journal of Alloys and Compounds. 615. 131-134 (2014). (Year: 2014).*

* cited by examiner

*Primary Examiner* — Sheng H Davis
(74) *Attorney, Agent, or Firm* — David Kelley; Brook Kushman P.C.

(57) ABSTRACT

A method comprising sintering a Mn and Bi powder compact at a first temperature for a first predetermined duration, based on the first temperature, and sintering the compact at a second temperature, less than the first temperature, for a second predetermined duration, greater than the first duration, is disclosed. The sintering at a first temperature for a first predetermined duration generates a predetermined MnBi LTP transition driving force to decrease a formation energy barrier for transition to MnBi LTP. Sintering the compact at the second temperature for the second predetermined duration forms a magnet containing the MnBi LTP.

5 Claims, 3 Drawing Sheets

PREPARATION OF MNBI LTP MAGNET BY DIRECT SINTERING

TECHNICAL FIELD

The present disclosure relates to a low temperature phase (LTP) manganese bismuth (MnBi) permanent magnet and a method of producing the same.

BACKGROUND

MnBi alloys have been identified as suitable substitutes for rare-earth permanent magnets because of their unique properties such as high coercivity which increases with temperature, thus providing higher stability in demagnetizing magnetic fields at high temperatures. This is particularly important for use in traction motors which normally operate at high temperatures. Obtaining a magnetic low temperature phase (LTP) MnBi alloy having high purity and high yield of the LTP remains difficult, partially because of the peritectic reaction between manganese (Mn) and bismuth (Bi), and because of the low phase transition temperature required to nucleate and grow MnBi LTP.

SUMMARY

According to an embodiment, a method comprising sintering a Mn and Bi powder compact at a first temperature for a first predetermined duration, based on the first temperature, and sintering the compact at a second temperature, less than the first temperature, for a second predetermined duration, greater than the first duration, is disclosed. The sintering at a first temperature for a first predetermined duration generates a predetermined LTP transition driving force to decrease a formation energy barrier for transition to MnBi LTP. Sintering the compact at the second temperature for the second predetermined duration forms a magnet containing the MnBi LTP.

According to one or more embodiments, the first predetermined duration may be between about 1 and 120 minutes. The first temperature may be between about 360 and 900° C. The second predetermined duration may be between about 1 and 48 hours. The second temperature may be about 260 to 450° C. In some embodiments, the method further may include mixing and pressing the Mn and Bi powder to form the compact. An x-ray diffraction peak intensity of the MnBi LTP may be at least twice that of a Bi peak in the magnet. In some embodiments, the method may further include crushing and milling the magnet to form an MnBi LTP containing powder, pressing the MnBi LTP containing powder into a LTP containing compact, and repeating the sinterings. In yet another embodiment, the method may further include crushing and milling the magnet to form an MnBi LTP containing powder, pressing the MnBi LTP containing powder into a LTP containing compact, and repeating the sintering at the second temperature for the second predetermined duration.

According to an embodiment, a high yield MnBi LTP magnet formed by the method above is disclosed.

According to an embodiment, a method of producing a high yield MnBi LTP magnet is disclosed. The method comprises sintering a Mn and Bi powder compact at a first temperature for a first duration, and sintering at a second temperature, less than the first duration, for a second duration, greater than the first duration, such that an MnBi LTP x-ray peak intensity is at least twice that of Bi. Sintering the compact at the first temperature for the first duration provides a phase transition driving force for nucleation and growth of MnBi LTP.

According to one or more embodiments, the method may further comprise crushing and milling the compact to form an MnBi LTP containing powder. The method may further include pressing the MnBi LTP containing powder into an LTP containing compact, and repeating both the sinterings, or the sintering at the second temperature for the second duration. The milling may include low energy ball milling, cryo-milling, or jet milling. In some embodiments, the first temperature may be between about 360 and 900° C. The first duration may be between about 1 and 120 minutes. The second temperature may be about 260 to 450° C. The second duration may be between about 1 and 48 hours. According to some embodiments, the Mn and Bi powder compact may be about a 0.8:1 to 1:0.8 atomic ratio mix of milled Mn powder and milled Bi powder. In yet another embodiment, the first temperature may be about 660° C. and the first duration may be between about 40 and 80 minutes, and the second temperature may be about 340° C. and the second duration may be about 24 hours.

DETAILED DESCRIPTION

Figure 1:
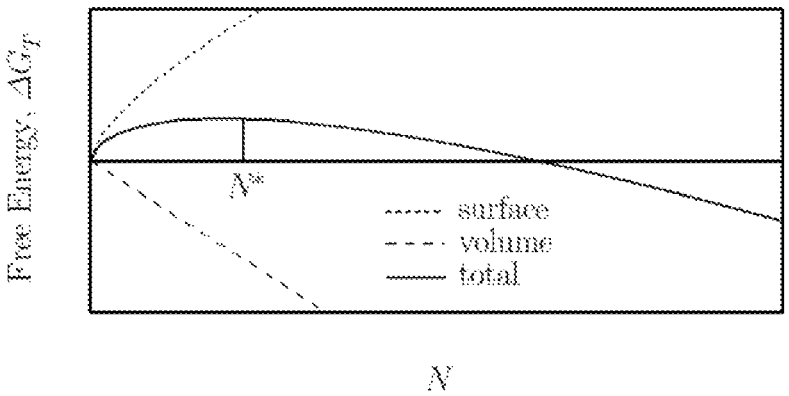
FIG. 1 is a graph showing the effect of nucleation on the total free energy of an alloy system.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Except where expressly indicated, all numerical quantities in this description indicating dimensions or material properties are to be understood as modified by the word "about" in describing the broadest scope of the present disclosure.

The first definition of an acronym or other abbreviation applies to all subsequent uses herein of the same abbreviation and applies mutatis mutandis to normal grammatical variations of the initially defined abbreviation. Unless expressly stated to the contrary, measurement of a property is determined by the same technique as previously or later referenced for the same property.

Reference is being made in detail to compositions, embodiments, and methods of the present invention known to the inventors. However, it should be understood that disclosed embodiments are merely exemplary of the present invention which may be embodied in various and alternative forms. Therefore, specific details disclosed herein are not to be interpreted as limiting, rather merely as representative bases for teaching one skilled in the art to variously employ the present invention.

The description of a group or class of materials as suitable for a given purpose in connection with one or more embodiments of the present invention implies that mixtures of any two or more of the members of the group or class are suitable. Description of constituents in chemical terms refers to the constituents at the time of addition to any combination specified in the description, and does not necessarily preclude chemical interactions among constituents of the mixture once mixed. The first definition of an acronym or other abbreviation applies to all subsequent uses herein of the same abbreviation and applies mutatis mutandis to normal grammatical variations of the initially defined abbreviation. Unless expressly stated to the contrary, measurement of a property is determined by the same technique as previously or later referenced for the same property.

A permanent magnet is a type of material which creates its own persistent magnetic field. Permanent magnets are used in a variety of applications. For example, in green energy applications such as electric vehicles or wind turbines, neodymium-iron-boron (Nd—Fe—B) magnet has been typically utilized. For such applications, the permanent magnets must be able to retain magnetism at high temperatures. Permanent magnet materials have been widely used in electric machines for a variety of applications including industrial fans, blowers and pumps, machine tools, household appliances, power tools, electric vehicles, and disk drives. For most of the applications, especially the high-end applications, for example, in electric vehicles, high performance rare earth permanent magnet materials are needed.

Rare earth elements, which are capable of generating a high anisotropic field, and thus have been essential component for high coercivity permanent magnets, have been typically used to produce such permanent magnets. In addition, heavy rare earth metals have been used to enhance coercivity to stabilize permanent magnets for high temperature operation. Rare earth materials are expensive, in particular, heavy rare earth materials are much more expensive than light rare earth materials, and supplies of those materials are at risk. There have been plenty of efforts in seeking for rare earth free permanent magnet materials.

Among the various types of the rare-earth-free permanent magnets, an MnBi magnet is one of the most promising materials for high temperature permanent magnet applications. The low temperature phase (LTP) of the MnBi alloy has a high magnetic crystalline anisotropy of $1.6\times10^6$ $Jm^{-3}$. The ferromagnetic LTP of the MnBi alloy has a unique feature, specifically, coercivity of the LTP of the MnBi alloy has a large positive temperature coefficient, which means that the coercivity of a magnet made from the LTP MnBi increases with increasing temperature. This unique feature makes the MnBi magnet an excellent candidate for high temperature applications to replace rare earth-based permanent magnet which normally contains even more expensive heavy rare earth elements for high temperature applications, or at least to decrease the dependence on the heavy rare earth elements.

Yet, the saturation magnetization of the MnBi alloy is relatively low at about 0.9 T at 300 K. The MnBi alloy is usually composed of other phases such as non-magnetic Mn and Bi, which are phases that do not contribute to the magnetic property. The MnBi magnet can be either used directly as a permanent magnet or for exchange coupled nanocomposite magnets. A prerequisite for all the applications is that the magnet has high purity MnBi LTP. But achieving a high volume ratio of the MnBi LTP in the MnBi alloy has been problematic.

MnBi LTP is typically prepared from Mn—Bi alloys, but the phase transition from the individual Mn phase and Bi phase to MnBi LTP occurs below 360° C., which is very low for the atoms to overcome the energy barriers for phase transition. Due to the low temperature and low-energy atoms, the phase transition is typically extremely slow, resulting in complicated and expensive approaches to prepare the magnet. These approaches include methods like melt spinning, ball milling, and arc melting followed by annealing. Using processes like these are typically very expensive, rendering them difficult to scale up for mass production.

Conventional metallurgical methods such as arc melting and sintering may be economically feasible, but the MnBi alloy prepared by these methods contains a relatively high volume of non-magnetic Mn and Bi phases because the reaction between Mn and Bi is peritectic such that a solid phase and a liquid phase form a second solid phase at a certain temperature. During solidification, Mn solidifies into big grains first out of the MnBi liquid. A heat treatment or annealing is performed at a low temperature to get the MnBi LTP. Yet, the volume ratio of the MnBi LTP is limited by the nature of the peritectic reaction and by the low reaction temperature. The reaction between Mn and Bi is slow, pure MnBi LTP is still not achievable even after various heat treatments, and the complicated, long time heat treatment significantly increases the cost.

FIG. 1 illustrates the effect of nucleation on the total free energy of the alloy system based on the numbers of atoms (N). As discussed above, although direct sintering of Mn and Bi powders has been tried, the low phase transition temperature of 360° C. results in an extremely long annealing time. Not only is the nucleation rate of the MnBi LTP low at this temperature, but the formation of the LTP creates new interfaces between the LTP and the initial alloy due to the peritectic reaction. Although the formation of the LTP decreases the total energy of the mixture, when the MnBi LTP is small, it is not able to cancel the energy increases due to the formation of the new interface as shown in FIG. 1. This makes the phase transition slow, or even result in it proceeding in the reverse direction such that the LTP decomposes to Mn and Bi.

Figure 2:
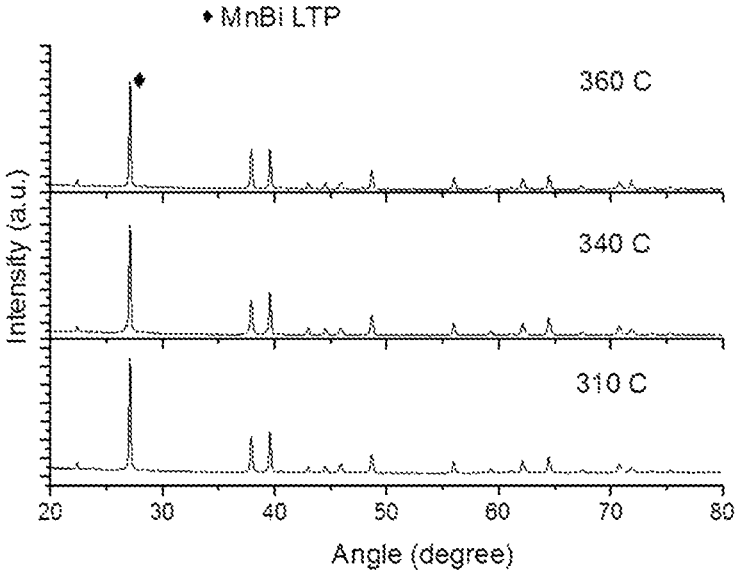
FIG. 2 is a graph showing x-ray diffraction patterns of Mn—Bi sintered at and below 360° C. for 24 hours.

By direct sintering at different temperatures below the low phase transition temperature of 360° C., the yield is extremely low. By extending the annealing time, the improvements in yield are limited and require days, even weeks of annealing to get a significant yield improvement. FIG. 2 shows the x-ray diffraction pattern result of direct sintered Mn—Bi at different temperatures below 360° C. for 24 hours. In FIG. 2, even the peak of MnBi LTP with the highest relative intensity (as labeled using a solid diamond) is almost invisible, thus indicating the low yield of MnBi LTP.

According to one or more embodiments, a method of preparing an MnBi LTP magnet by two-stage direct sintering is disclosed. The advantage of the process described herein lies in the ability to utilize a powder metallurgical method for direct sintering of Mn and Bi powders at two stages to increase the LTP yield of the MnBi LTP magnet. The disclosed method overcomes the energy barrier resulting in a higher yield without the segregation problem in the resultant magnet, thus providing a high yield MnBi LTP magnet.

The method utilizes powders of individual components Mn and Bi, which are mixed and sintered. As far as the powders are mixed homogeneously, efficiency of the processing is less affected by the volume of the alloy, which makes the method easier to scale up for mass production. Powders of Mn and Bi are mixed using a mixer, cryo-miller, or low energy ball miller. The Mn powder and Bi powder are mixed with an atomic ratio of between about 0.8:1 to 1:0.8. In an embodiment, the Mn and Bi powder are mixed with an atomic ratio of about 1:1. The mixed powder is then pressed into compacts, such as green compacts. The compacts are then sintered in an inert gas atmosphere, such as argon, nitrogen, or helium. The atmosphere may also be mixture of these inert gases, or mixture of inert gases with hydrogen since hydrogen can prevent oxide formation.

Figure 3:
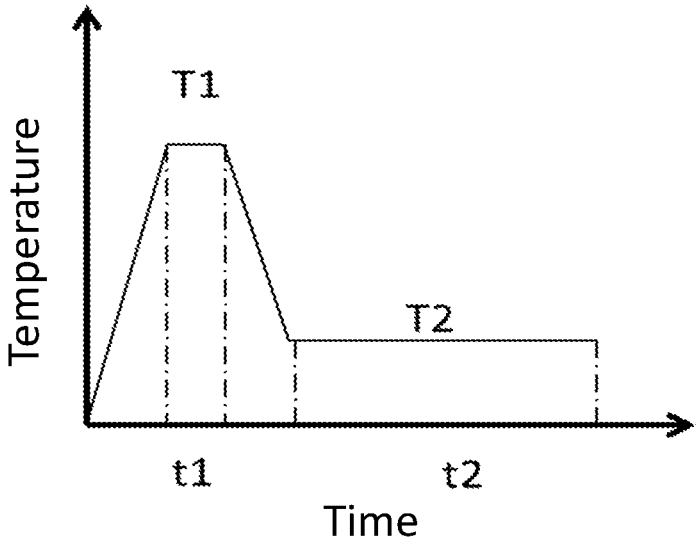
FIG. 3 is a schematic diagram of the sintering method according to an embodiment.

FIG. 3 shows a schematic diagram of the sintering steps according to one or more embodiments. The sintering of the compact is a two-stage process, where the compact is first sintered for a first stage at a first temperature for a first predetermined duration, and then sintered for a second stage at a second temperature for a second predetermined duration. The first and second predetermined durations are based on the first and second temperatures for sintering. As shown in FIG. 3, the temperature in a furnace for sintering is increased to a first temperature T1 for a duration t1. The temperature is then decreased to the second temperature T2, for a second duration t2 which is longer than duration t1. The first temperature T1 may be between about 360 to 900° C. In some embodiments, the first temperature T1 may be between about 360 to 800° C. The first duration t1, i.e. the shorter duration, may be between about 1 and 120 minutes. In some embodiments, the first duration t1 may be between about 10 and 120 minutes. The second temperature T2 may be between about 260 to 460° C. In some embodiments, the second temperature T2 may be between about 260 to 360° C. The second duration t2, i.e. the longer duration, may be between about 1 and 48 hours. In some embodiments, the second duration t2 may be between about 1 and 24 hours. In other embodiments, the second duration t2 may be between about 4 and 24 hours. A high cooling rate between stages is preferred to promote MnBi LTP formation.

By adding the first sintering stage with higher temperature, the interphase diffusion between Mn and Bi can be promoted, and the formation energy barrier is decreased for MnBi LTP grain growth. The driving force of the phase transition is increased into a predetermined range to decrease the formation energy barrier. A predetermined MnBi LTP transition driving force is established based on the selected temperature and duration of the first stage, in order to decrease the formation energy barrier to make the transition to MnBi LTP more favorable. Sintering through both stages improves the growth of MnBi LTP atomic clusters. Once the number of atoms overpass N*, as depicted in FIG. 1, the cluster growth would be more energetically favorable, and thus, the phase transition is accelerated. As such, increasing the temperature of T1 or the length of the first duration t1 relative to the second stage, the volume ratio of the MnBi LTP can be improved.

Figure 4:
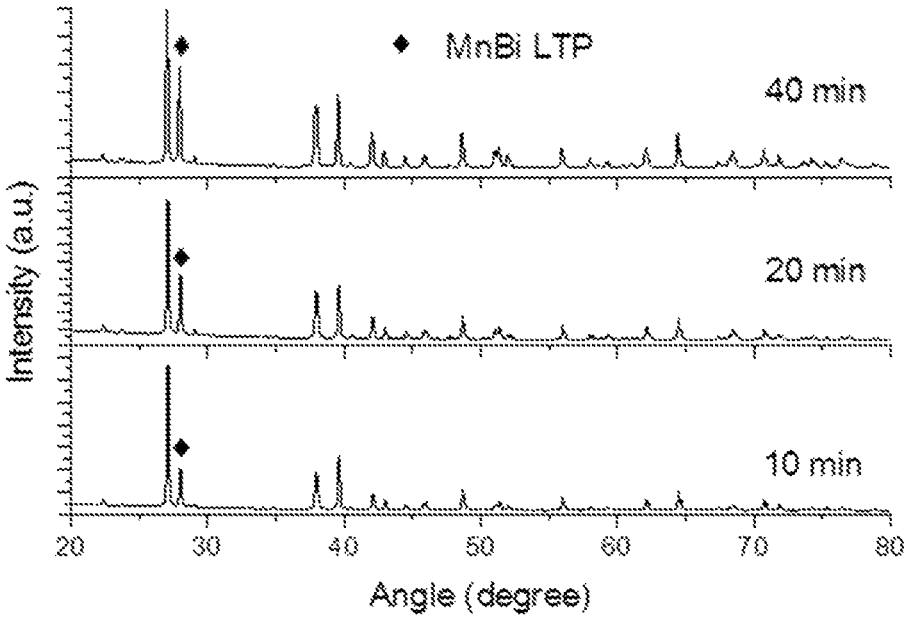
FIG. 4 is a graph showing x-ray diffraction patterns of Mn—Bi sintered at 560° C. for different durations as the first stage before low temperature sintering according to an embodiment.

FIG. 4 shows an x-ray diffraction pattern of MnBi for an exemplary compact sintered at 560° C. for different durations. The exemplary compact was sintered at 560° C. (T1) for 10 minutes (t1), and then the temperature was decreased to 340° C. (T2) for 24 hours (t2). Comparing FIG. 4 with the direct sintering for a single stage at 340° C. for 24 hours, as shown in FIG. 2, shows that the volume ratio improvement by using a two-stage approach is significant. In FIG. 4, the peak of MnBi LTP in the x-ray diffraction pattern is apparent, and the intensity of the peak increases gradually with extended time at 560° C. The increase in the peak intensity indicates that the volume ratio of MnBi LTP improves with time, as there are smaller peaks for the other constituents.

Figure 5:
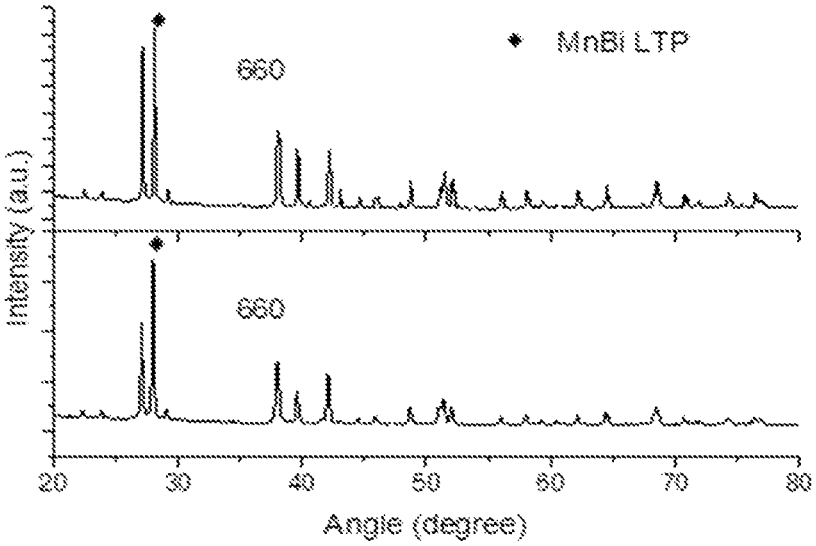
FIG. 5 is a graph showing x-ray diffraction patterns of Mn—Bi samples sintered at different durations (40 min (top), and 80 min (bottom)) according to an embodiment.

In some embodiments, the first duration t1 may be optimized to provide the strongest predetermined phase transition driving force to overcome the energy barrier to allow for a quicker phase transition during the second phase. For example, FIG. 5 shows x-ray diffraction patterns of MnBi samples sintered for a first stage at 660° C. for 40 minutes (top), and 80 min (bottom), and then sintered for a second stage at 340° C. for 24 hours. FIG. 5 illustrates that 80 minutes is sufficient for this first temperature T1 to yield a higher volume ratio of MnBi LTP as shown by the characteristic peak of MnBi LTP being much stronger than the remaining Bi (next to, on the left of the MnBi LTP peak). Thus, high costs and segregation can be avoided by the two-stage process since the first stage provides a phase transition driving force, and can be optimized for the temperature selected.

By increasing T1, the x-ray diffraction peak intensity of MnBi can be gradually increased, but when the temperature is too high, above 900° C., segregation occurs between the phases, and the distance between Mn and Bi atoms becomes much longer, which makes the phase transition hard to continue. The duration of the first stage t1 is very important for the formation of MnBi LTP. Generally longer time is better for the formation of MnBi LTP, but segregation may also occur beyond the optimized duration of t1 for the corresponding temperature. In other embodiments, the first temperature T1 can be higher in conjunction with a longer second duration t2 may result in a higher peak intensity of MnBi LTP compared to the Bi peak.

In some embodiments, the method may further include repeating the sintering process. Before repeating the sintering, the sintered compact (containing MnBi LTP) can be crushed and cryo-milled, low energy ball milled or jet milled into fine powders (MnBi LTP containing powder) and pressed into an LTP containing compact to repeat the sintering process to improve the weight ratio further. In some embodiments, both sintering stages are repeated. In one or more embodiments, only the second sintering stage is repeated. In other embodiments, the milled powders can be separated using a jet miller to separate MnBi LTP from the individual phases, and the remaining Mn and Bi powders can be pressed into a compact and re-sintered through the two-stage process to get even higher overall yield.

A method of preparing an MnBi LTP magnet by two-stage direct sintering is disclosed. The two-stage sintering method provides a first stage to increase the phase transition driving force, such that in the second stage, a higher yield of MnBi LTP is grown. The two-stage process provides an efficient way to increase the yield of the MnBi LTP by greatly reducing the time needed to achieve a high yield of MnBi LTP, while still providing a technically and economically feasible approach for mass production.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of producing a high yield MnBi LTP magnet comprising:

sintering a Mn and Bi powder compact at a first temperature for a first duration to provide a phase transition driving three for nucleation and growth of MnBi LTP; and sintering at a second temperature, less than the first duration, for a second duration, greater than the first duration, such that an MnBi LTP x-ray peak intensity is at least twice that of Bi, wherein the first temperature is about 660° C. and the first duration is between about 40 and 80 minutes, and the second temperature is about 340° C. and the second duration is about 24 hours.

2. The method of claim 1, further comprising crushing and milling the compact to form an MnBi LTP containing powder.

3. The method of claim 2, further comprising pressing the MnBi LTP containing powder into an LTP containing compact, and repeating both the sinterings at the first and second temperatures for the first and second durations, respectively, or the sintering at the second temperature for the second duration.

4. The method of claim 2, wherein the milling includes low energy ball milling, cryo-milling, or jet milling.

5. The method of claim 1, wherein the Mn and Bi powder compact is about a 0.8:1 to 1:0.8 atomic ratio mix of milled Mn powder and milled Bi powder.

* * * * *